US006019476A

United States Patent [19]

Kirschner

[11] Patent Number: 6,019,476

[45] Date of Patent: Feb. 1, 2000

[54] FULL SPECTRUM FILTERING FOR FLUORESCENT LIGHTING

[76] Inventor: Kevin A. Kirschner, 1005 Sapphire La., Corona, Calif. 91720

[21] Appl. No.: 08/783,605

[22] Filed: Jan. 14, 1997

Related U.S. Application Data

[60] Provisional application No. 60/020,294, Jun. 24, 1996.

[51] Int. Cl.[7] ..... F21V 9/02

[52] U.S. Cl. ..... 362/2; 362/147; 362/293; 362/260

[58] Field of Search ..... 362/2, 260, 293, 362/147

[56] References Cited

U.S. PATENT DOCUMENTS

| | | | |
|---|---|---|---|
| 3,112,886 | 12/1963 | Kushner . | |
| 3,355,982 | 12/1967 | Rendina | 362/2 |
| 3,757,101 | 9/1973 | Semotan . | |
| 3,757,103 | 9/1973 | Walter . | |
| 4,796,160 | 1/1989 | Kahn . | |
| 5,075,823 | 12/1991 | Chomyn . | |
| 5,184,881 | 2/1993 | Karpen . | |
| 5,285,362 | 2/1994 | Sakata . | |
| 5,329,435 | 7/1994 | McGuire | 362/2 |
| 5,359,498 | 10/1994 | Karpen . | |

*Primary Examiner*—Thomas M. Sember
*Attorney, Agent, or Firm*—Knobbe, Martens, Olson & Bear LLP

[57] ABSTRACT

A filter in the form of a lens or panel or a sleeve for a fluorescent light source made with pigments therein that will modify the fluorescent output to resemble daylight. An ultraviolet absorber is also included in the panel.

25 Claims, 3 Drawing Sheets

FULL SPECTRUM FILTERING FOR FLUORESCENT LIGHTING

RELATED APPLICATION

Pursuant to 35 U.S.C. § 119(e) this application claims the priority benefit of provisional application 60/020,294 filed Jun. 24, 1996.

FIELD OF THE INVENTION

The present invention relates to room illumination, and in particular, it relates to methods of enhancing or suppressing various bandwidths of visible and invisible electromagnetic radiation emitted from artificial light sources, especially fluorescent lighting. The present invention results in the production of a filtering device for artificial light sources that is capable of reproducing a spectral output similar to that of natural outdoor sunlight, and at the same time results in a decrease in, or elimination of, harmful ultraviolet (UV) rays emitted from the artificial light source.

BACKGROUND OF THE INVENTION

Fluorescent lighting technology has been in existence for over 50 years. Since its inception, what was gained in energy efficiency and decreased operating temperature, was lost in lighting quality and spectral purity. Historically, artificial lighting has evolved from light given off by fire, to light produced by incandescent bulbs, to fluorescent tubes, to the new "full-spectrum" fluorescent and incandescent bulbs. However, each lighting source has had its drawbacks. For instance, the incandescent bulb generates excessive heat and is high in energy consumption. Fluorescent light, on the other hand, gives off adequate light, is not excessively hot to the touch, but one of the drawbacks is that this light source emits far too much yellow and green spectral output, as compared with natural daylight. The "full-spectrum" bulbs currently available, come closer to producing the full spectrum of visible daylight, but these light sources utilize the red rare earth phosphors to emit the red spectrum of light which burn out in about one-half the life of the bulb, thus rendering their use prohibitively expensive. Thus, an inexpensive solution to the longstanding problem of inefficient, substandard lighting is sorely needed in today's lighting market.

The history of interior lighting design has generally focused on achieving lighting suitable to the task level, attractive in appearance, and energy efficient. In the past, however, the lighting designer did not factor certain aspects of the human vision system into the design of interior light sources. In particular, throughout the modern period of electric lighting, little consideration has been given to the "nonvisual" aspects of light.

Today, it is generally known that light is vital to human health and well-being. For example, it is known that light entering the human eye regulates body chemistry, especially the secretion or suppression of a biochemical substance known as melatonin. It is the melatonin levels in the blood stream that regulate human activity and energy levels. High melatonin levels causes drowsiness, while low melatonin in the blood stream corresponds to an alert state of human consciousness.

It is necessary to understand how the human body reacts to light before one can fully appreciate the benefits of artificial lighting capable of providing the full spectral output of natural daylight. Visible light is defined as electromagnetic radiation spanning the wavelengths of violet (380–430 nm), blue (430–490 nm), green (490–560 nm), yellow (560–590 nm), orange (590–630 nm), to red (630–700 nm). In terms of light having an effect on the human body, there are two physical pathways for light absorption: through the skin and through the eyes. It is also known that necessary photochemical reactions that occur within the body tend to involve very specific wavelengths of the visible light spectrum.

Today, the fluorescent tube, which produces a "cool-white" light has replaced the incandescent light in many interior lighting applications. Fluorescent light tubes are very efficient forms of light as compared to incandescent lighting. For example, fluorescent light tubes can emit approximately four times as much light per unit of electricity as compared to a comparable incandescent bulb. However, even though fluorescent lamps provide a relatively high level of illumination, they fail to compensate for the necessary color-balance that natural light provides. It is now clear that there is a basic biophysical requirement for lighting that contains the proper levels of all seven constituent colors of the entire visible spectrum, that is, full spectrum lighting.

The benefits of full spectrum lighting are well-documented. An experimental study involving first grade classrooms equipped with either cool-white fluorescent lighting or full spectrum lighting showed that the children in the classroom that received full spectrum lighting were less hyperactive. In another group within the same study, the academic level of the learning disabled children rose substantially in the classroom with full spectrum lighting, as compared with that of the classroom with fluorescent lighting. Furthermore, with the same two groups, it was also found that the children exposed to full spectrum lighting had less cavities than their peers in the classrooms with cool-white lighting.

Additionally, full spectrum lighting has been shown to have an effect on ameliorating sleep disorders and increasing energy enhancement. It has been postulated that these positive effects of full spectrum lighting are due to the light's ability to regulate the body's melatonin and serotonin levels. Other positive effects have been seen with Seasonal Affective Disorders (SAD), which is triggered by the shortening of daylight in the winter periods. Again, the biochemical basis is thought to reside in the ability of full spectrum light to regulate melatonin levels.

Moreover, the effects of UV radiation emitted from fluorescent lighting has been addressed by several studies. Fluorescent lights work by placing an anode and a cathode at opposite ends of a glass tube. Inside a tube is a partial vacuum and a small amount of mercury vapor. When energized, the mercury vapor is ionized and emits ultraviolet (UV) radiation. The inside surface of the tube is coated with a phosphorous powder that "fluoresces" (gives off light) when stimulated by the UV radiation, and thus, visible light is produced. Not surprisingly, research studies have found that the incidence of malignant melanomas was considerably higher in office workers, as compared with individuals who were regularly exposed to daylight. Other recent studies have shown that the incidence of cutaneous malignant melanoma increases with exposure to normal fluorescent lighting. In this particular study, the data suggests that human exposure to fluorescent lighting may result in ultraviolet B dosages much greater than that of sun. Thus, there is also a need to filter or eliminate the UV radiation, especially the ultraviolet B component, that is emitted from fluorescent lighting.

There are still other problems inherent in the human use of fluorescent light sources. One particular problem is that fluorescent light tubes emit a high greenyellow spectrum of light. It is also known that the retina of the human eye is more sensitive to this particular portion of the visible light spectrum, that is, the cones or daytime receptors cells of the retina are activated in such a way as to result in a color shift, or unnatural color rendering, to the human eye. Thus, fluorescent lighting produces poor color rendering ability to the human visual system.

Additionally, the list of work and home-related complaints associated with the use and prolonged exposure to fluorescent lighting includes headaches, eyestrain, reduced attention span, reduced shelf life of meat and dairy products, yellowing of printed materials, and fading of dyed materials. Moreover, the health-related symptoms associated with the prolonged use of fluorescent lighting often result in absenteeism from work and substandard effectiveness on the job.

In U.S. Pat. No. 5,075,823 to Chomyn, an attempt was made to correct the green-magenta balance of the spectral output of fluorescent lighting utilizing a sheet of filter material positioned between a fluorescent bulb and a conventional lens or panel in a light fixture. This technique merely reduced some of the green portion of the visible light spectrum. The Chomyn patent nowhere describes a "full spectrum" attempt, nor anything else, except to achieve the "green-magenta" balance found in sunlight. In U.S. Pat. No. 3,112,886 to Kushner, an attempt was made to simulate the full spectrum of natural daylight by utilizing a coating of small colored beads or particles glued to a reflector or lens adjacent a fluorescent bulb. The mixture of particles disclosed in the patent is disproportionate with the proper correction of the spectral emissivity curves of both warm white and cool-white lighting. Thus, in both of these patents, full spectrum, or its close approximation was either not attempted or not achieved. Moreover, no previous attempts are known to have been made to correct, or eliminate, the harmful UV radiation emitted along with fluorescent light sources.

Thus, there is an urgent need to provide lighting sources that more closely resemble the spectral output of natural daylight, and at the same time reduce any harmful UV radiation, especially the ultraviolet B component, that is emitted as a consequence of the fluorescent lighting technology.

SUMMARY OF THE INVENTION

An approach to fill this need is met by providing fluorescent light sources that more closely mimic the spectral properties of natural daylight for use in interior commercial and residential settings. The present invention provides a light filtering device for use with fluorescent lighting and a method for producing a light source that is more comparable to that of natural daylight. Thus, the device when used with an artificial light source can more closely obtain the full spectrum of natural light.

In particular, the invention comprises a fluorescent light source located in the vicinity of a "full spectrum" light filtering substrate containing color pigments that are provided in the proper proportions to provide filtered light that more closely reproduces the spectral output of natural daylight.

DETAILED DESCRIPTION OF THE PREFERRED EMBODIMENT

The present invention resides in a full spectrum light filtering device for fluorescent light sources. This light filtering device, when used in conjunction with a fluorescent light source, results in a spectral output that more closely resembles that of natural daylight. Thus, the effect of the filtering device is referred to as "full spectrum" lighting. The device is produced by impregnating certain color pigments within, or atop of, a substrate. The substrate is positioned between a fluorescent light source and the area to be illuminated. The substrate is preferably constructed from a resin, for example, a polystyrene resin, acrylics or a polycarbonate resin. The substrate is primarily formed into (1) a sleeve which fits around a fluorescent light bulb, (2) a flat sheet which is placed near the fluorescent light source, (3) a flat prismatic panel, or (4) any other type of covering placed in close proximity to a fluorescent light source. This includes, but is not limited to, profiles, diffusers, domes, shades, drums and the like. The flat sheets or prismatic panels can be constructed to be part of the structure that houses one or more fluorescent light bulbs.

The purpose of the substrate in the present invention is to allow the colored pigments, or similar coloring agents, to be impregnated, so that a more natural spectral output is achieved when used in conjunction with a fluorescent light source. The amount of the color pigment, as well as the selection of color types will depend upon the chemical and physical nature of the light source used with the filtering device.

Figure 1:
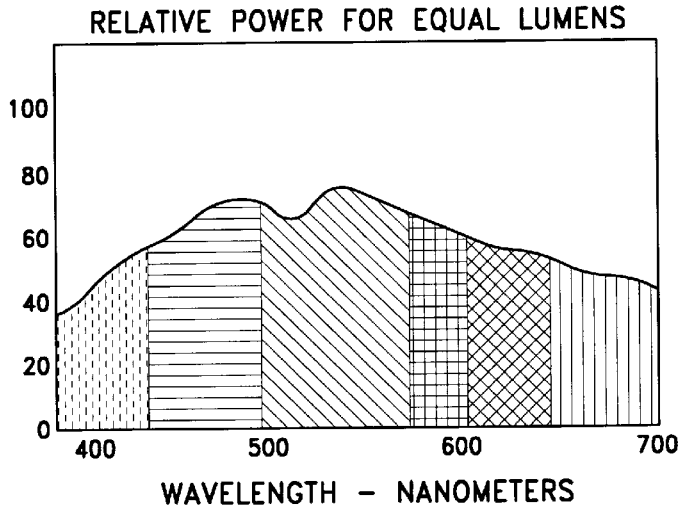
FIG. 1 shows the spectral output of natural daylight.
Figure 2:
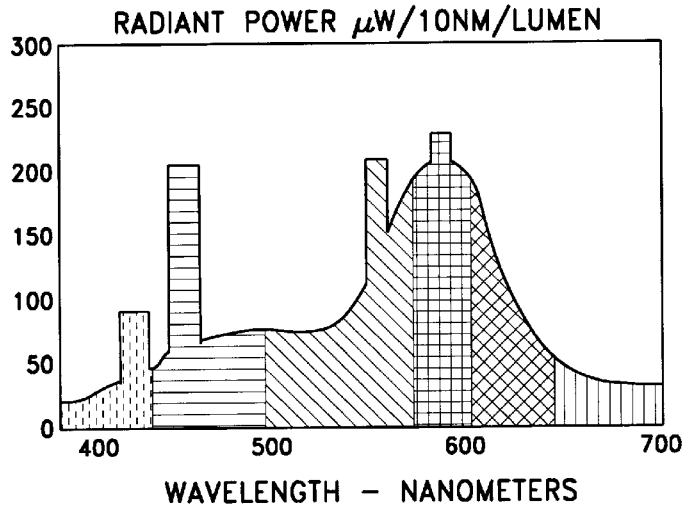
FIG. 2 shows the spectral output of a cool-white fluorescent bulb.

For example, FIG. 1 shows the visible spectrum of natural daylight, as compared with FIG. 2 which depicts the spectral output of a standard "cool-white" fluorescent bulb. The differences in the two spectral outputs are notable. The average relative power output for the daylight graph of FIG. 1 is also illustrated in numerical form in the first column of the chart listed below. As may be seen, green has the highest relative power output. As one way to compare the color differences, the second column of the chart lists the percentage of difference of each of the colors from green, etc. Thus, it may be seen that violet is 34% less than green, etc.

| COLOR: | DAYLIGHT AVERAGE RELATIVE POWER OUTPUT: | DAY-LIGHT % DIFFER-ENCE FROM GREEN | COOL-WHITE AVG. RADI-ANT POWER OUTPUT/ LUMEN | COOL-WHITE DIFFERENCE FROM GREEN |
|---|---|---|---|---|
| Violet (380–430 nm) | 48 | (−) 34 | 50 | −61% |
| Blue (430–490 nm) | 70 | (−) 3 | 115 | −11% |
| Green (490–560 nm) | 73 | 0 | 130 | 0 |
| Yellow (560–590 nm) | 68 | (−) 7 | 205 | +57% |
| Orange | 55 | (−) 24 | 125 | −4% |

-continued

| COLOR: | DAYLIGHT AVERAGE RELATIVE POWER OUTPUT: | DAY-LIGHT % DIFFER-ENCE FROM GREEN | COOL-WHITE AVG. RADI-ANT POWER OUTPUT/ LUMEN | COOL-WHITE DIFFERENCE FROM GREEN |
|---|---|---|---|---|
| (590–630 nm) Red (630–700 nm) | 45 | (−) 38 | 45 | −65% |

The graph for the cool-white fluorescent bulb shown in FIG. 2 indicates the radiant power output in $\mu$W/10NM/lumen and is listed by color in column 3 of the above chart. For convenient comparison purposes, the percentage difference from green of the cool-white bulb is shown in the fourth column of the chart, bearing in mind that the level of green in the two light sources is not the same. By comparing FIGS. 1 and 2 and comparing the second and fourth columns, it can be readily seen that the cool-white bulb output is very different from the natural daylight output of the chart.

The object of the invention is to create a filter which changes the component colors of light emitted by a cool-white fluorescent bulb to maintain the same percentage difference from the green spectra as is found in natural sunlight. This does not mean that the green component of the cool-white bulb is to remain constant but merely that the relationship to the other colors should be addressed. Thus, for example, the amount of violet should be increased relative to green or the amount of green decreased so that there is only a 34% difference rather than the 58% difference indicated in the fourth column.

By comparing the two graphs, it may be seen that the green and yellow output from the fluorescent light source is overly dominant. Thus, for example, it could be said that there is a need to add some violet, blue, orange and red while at the same time subtracting some green and yellow in order to balance out and more close mimic the full visible light spectrum of natural daylight. Moreover, it is clear that a mere subtraction of the overly dominant green and yellow output from the fluorescent light source would not create the full spectrum of natural light. Thus, all six colors of the visible spectrum must be altered to achieve "full spectrum lighting."

The present invention simulates, in an inexpensive, cost effective manner, the spectral distribution of natural daylight by the addition of the proper color pigments to a substrate to balance each of the above color components of visible light. In addition, a UV absorbing agent is added to reduce the harmful UV radiation, in particular Ultra Violet B, associated with the use of fluorescent light sources.

The present invention uses the principal that the primary colors of light, that is, red, green and blue can be added together to make the secondary colors of light, namely magenta (red+blue), cyan (green+blue), and yellow (red+green). In pigments, it should be further noted that a primary color subtracts or absorbs a primary color of light and reflects or transmits the other two. Thus, the primary color and pigments are the secondary colors of light namely magenta, cyan and yellow. In accordance with the invention, the substrates are impregnated with the specific type and color component to cause the substrate to interact with the fluorescent light source in such a manner as to recreate the full spectral properties of normal daylight.

In the primary form of the invention, the proper colors are combined into a lens or panel of the type commonly positioned beneath a fluorescent bulb in a lighting fixture. Thus, in a preferred form of the invention, the dyestuff or pigments necessary to create the desired result are mixed with the plastic used to make the panel.

In specific examples of making the panels, appropriate proportions of violet, black and green are combined with a UV absorber and then ultimately combined with clear acrylic material. In a more specific example, a violet dyestuff identified as anthraquinone was utilized bearing a trade name MACROLEX VIOLET 3R (violet 10) made by Keystone Pacific of Santa Fe Springs, Calif. having a color index name of solvent violet 36. It constitutes 1.22% of a pigment and UV mixture. In addition, there was included 0.98% of a black pigment sold under the trade name THERMOPLAST BLACK X70 (black 8) manufactured by BASF Corp., Mt. Olive, N.J. having color index name of solvent violet 13 and solvent yellow 93 mixture. Also included was 0.24% of green pigment sold under the trade name ATLASOL GREEN 4BL; (green 8) manufactured by Atlantic Industries of Nutley, N.J. having a color index name of solvent green 3 and the color index no. 61565. Its chemical or family name is anthracene, 9,10-Dihydro-9,10-Dioxo-1,4-Bis [4 (methylphenl) amino]. The remaining 97.56% of the mixture was composed of a UV absorber sold under the trade name TINUVIN 328 manufactured by Ciba-Geigy Corp. of Hawthorne, N.Y., under the family or chemical name 2-(2'-Hydroxy 3',5'-DI-Tert-Amylphenyl) Benzotriazole.

Leaving out the UV absorber or considering only the pigments, the mixture included about 50% violet, about 40% black and about 10% green. The powder mixture of dyestuffs and UV absorber was mixed with 200 grams of clear acrylic plastic pellets, although other materials such as polycarbonate or polystyrene can be used. The plastic/dyestuff mixture is then placed into an extrusion unit, heated and extruded into small colored pellets. These pellets make up a concentrated colorant to be used in the manufacture of the panels. The colored pellets are used by the panel manufacturer who places the concentrated pellets in another extrusion unit, to be blended with clear plastic pellets and made into a filter panel. The product is manufactured to have a light transmission between 60–90%, depending on the desired darkness of the product. The light transmission can be controlled by varying the quantity of clear plastic pellets mixed with the pigmented ones, or by varying the thickness of the filter.

Figure 3:
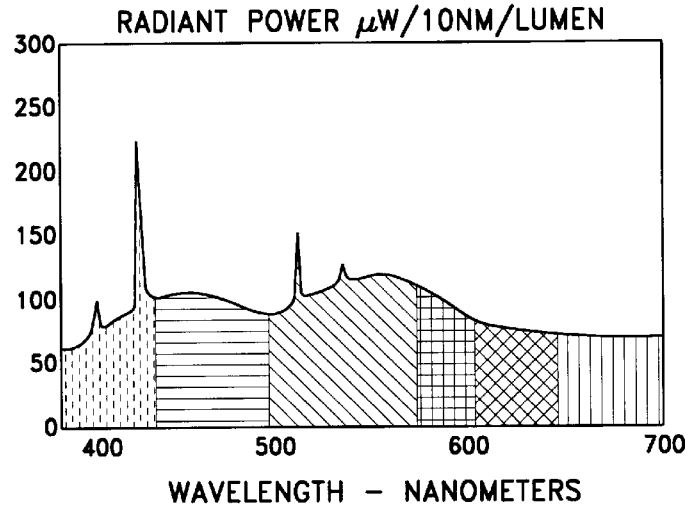
FIG. 3 depicts the spectral output of a cool-white fluorescent light source equipped with a filtering device of the present invention.

FIG. 3 illustrates the spectral distribution curve obtained from the combination of a cool-white fluorescent source with a filter panel of the type just described. As can be seen, there is a vast difference between it and the curve of FIG. 2, and that the curve is much closer to that illustrated in FIG. 1 for the daylight output. The intensity spikes shown in the blue and green wave lengths are difficult to completely eliminate, but they represent an insignificant amount of the output.

In another panel, a slightly different mixture was employed to also obtain a successful result. A mixture of 2.38% violet 8 sold under the MACROLEX trade name was combined with 1.9% of the black 8 listed above and 0.47% of green 8 mentioned above as combined with 95.23% of TINUVIN 26. The pigment percentages are once again 50% violet, 40% black and 10% green, although violet 8 is used instead of violet 10. Utilizing that mixture in combination with acrylic pellets fabricated in the manner described above to make a panel, the curve obtained is substantially the same as the output from the first panel as seen in FIG. 2.

In a third example, a pigment mixture of 41% violet, 47% black and 12% green was employed, with the violet being 5 parts violet 8 and 2 parts violet 4, as identified by the above-mentioned manufacturer. This pigment mixture was combined with TINUVIN, with that UV absorber representing about 95% of the light modifier in the overall mixture. A wide variety of other pigment combinations can be utilized to create the desired result, but it is emphasized that it is necessary to make adjustments to all or most all of the components in order to obtain the "fully balanced" spectrum as opposed to merely dealing with the predominantly over-balanced one such as yellow and green.

Lamp color can be specified by several methods, none of which is complete by itself, but all of which can be useful. These include x and y coordinates on an internationally agreed upon chromaticity diagram, chromaticity measured in Kelvins (K), color rendering index (CRI), and spectral power distribution curves.

The C.I.E. (International Commission on Illumination) diagram is based on the idea that any color of light can be created by mixing varying proportions of hypothetical primaries of red, green and blue. This can be mathematically represented by a "triangle", in which the perimeter encompasses spectrally pure colors (seen in nature only in rainbows and prisms) ranging from red to blue. Moving toward the center "dilutes" the color until it ultimately becomes a "white". Specifying the x & y coordinates locates a color on the color triangle. The panel illustrated in FIG. 3 exhibits chromaticity in the "white" central area having xy coordinates of about 3.5 and 3.1, whereas the lamp of FIG. 2 xy has coordinates 3.5 and 3.9, outside the "white area."

As metal is heated, it changes color from red to yellow to white to blue-white. The color at any point can be described in terms of the absolute temperature of the metal measured in kelvins (K). This progression in color can also be plotted on the "triangle", sometimes called the black body locus. The color can now be expressed in either x,y coordinates or in Kelvins. Color temperature, however, is not really a very precise measure of chromaticity.

The chromaticity of a light source defines its "whiteness", its yellowness, blueness, its warmth or its coolness. It does not define how natural or unnatural colors of objects will look when lighted by the source.

Sunlight exhibits a Kelvin temperature of 1800 K at sunrise, to 4870 K at noon, to 25,000 K in the Northwest sky. The average Kelvin temperature for sunlight lies between 5,000 K and 6,500 K. The standard cool-white bulb of FIG. 2 has a Kelvin temperature of about 4150. The first panel referred to above had a Kelvin temperature of about 4530, and the second was about 6298.

A system was devised some years ago that mathematically compares how a light source shifts the location of eight specified pastel colors on a version of the C.I.E. color triangle.

If there is no change in appearance, the source in question is given a CRI of 100 by definition. From 2000 K to 5000 K, the reference source is a black body radiator and above 5000 K, it is an agreed-upon form of daylight. CRI is useful in specifying color only if its limitations are understood. It was designed originally to compare continuous spectrum sources whose CRIs were above 90. Below 90 it is possible to have two sources with the same CRI, but which render color very differently. Therefore, a light source with a CRI of 90 or greater is considered to be "full-spectrum". Technically, CRIs can only be compared with sources with the same chromaticities. However, as a general rule, "The Higher The Better"; light sources with high (80–100) CRIs are going to make people and things look better than light sources with lower CRIs. The test panels of FIG. 3 have CRI values of about 89 and 87, respectively, while the third example referred to above produced a panel having a CRI value over 91. By contrast, the standard lamp of FIG. 2 has a CRI value of only about 62.

Figure 4:
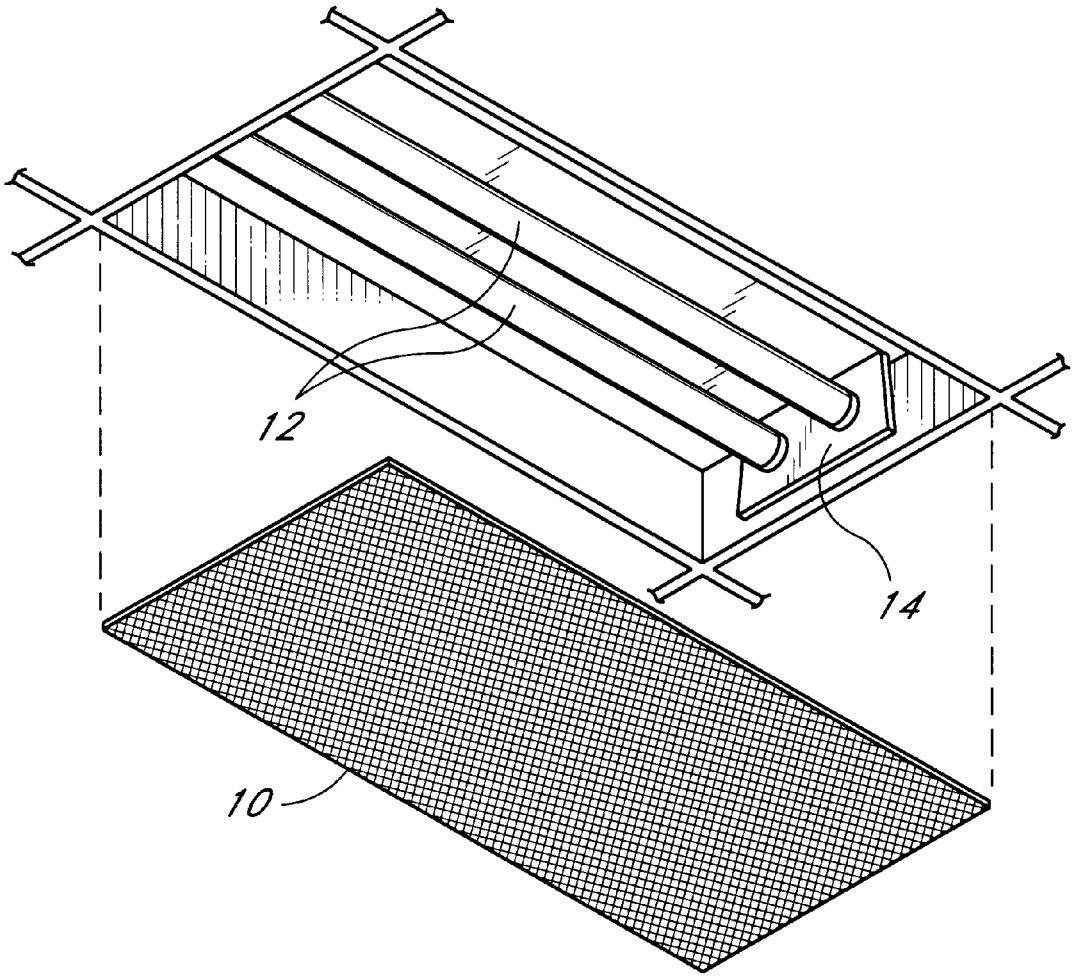
FIGS. 4, 5 and 6 schematically illustrate filtering devices incorporating the invention.
Figure 5:
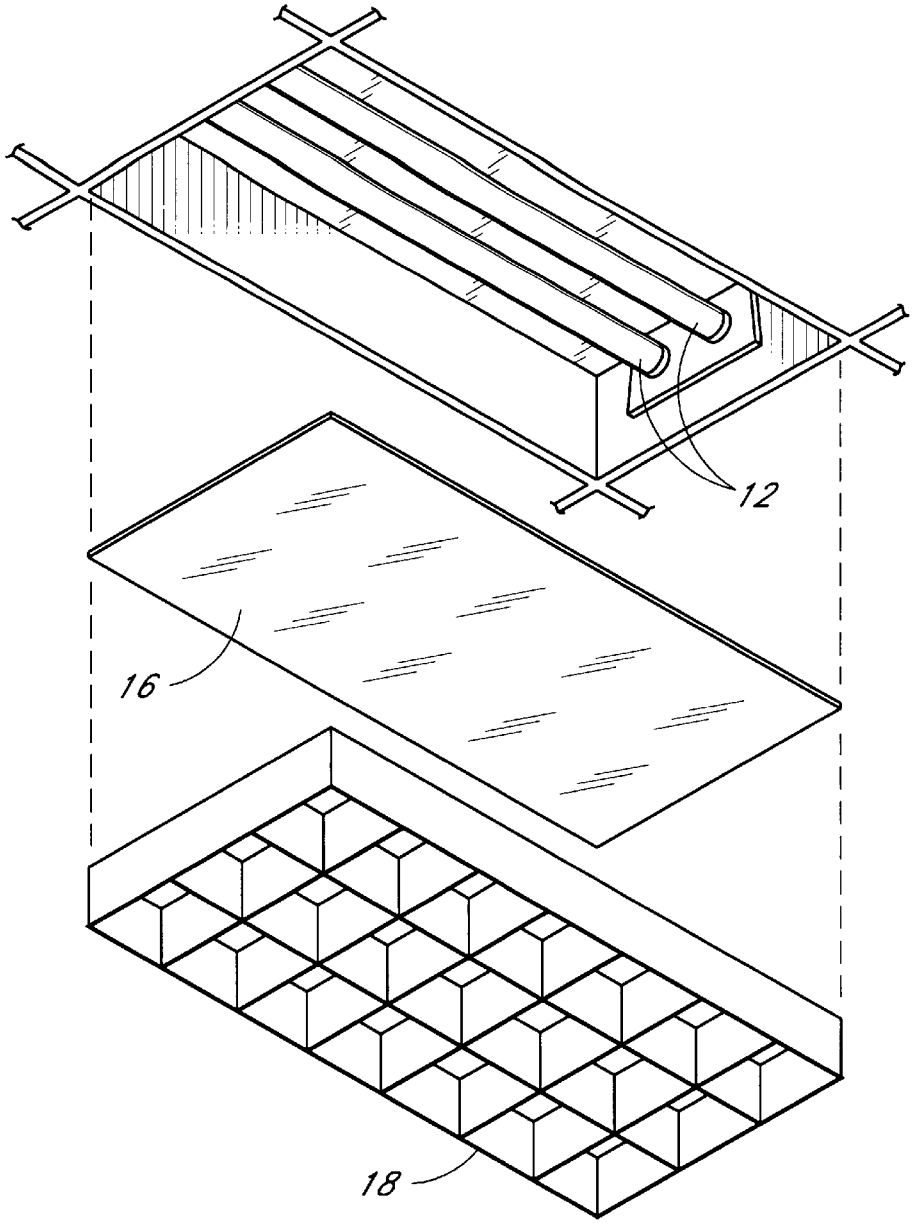
Figure 6:
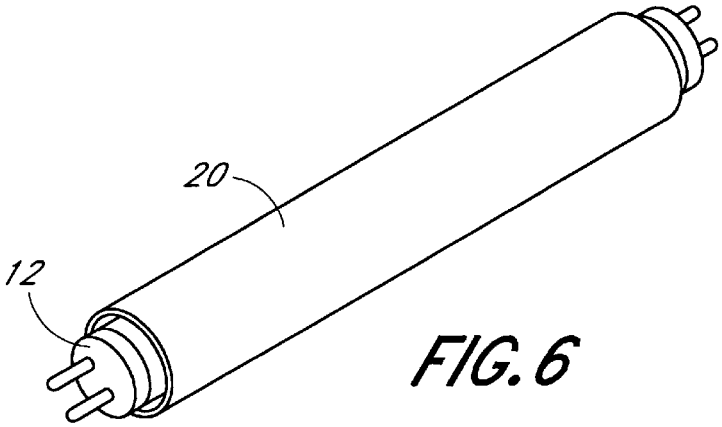

As mentioned, the pigments may be used to create a stiff prismatic lighting panel 10, as schematically shown in FIG. 4 beneath lamps 12 in a conventional light fixture 14; and they may be used to form flat sheets, profile channels, diffusers, lenses and the like for use with lighting fixtures. Further, the filter can also be made into a thin acrylic or polycarbonate film or sheet 16 that is laid on top of a louvre 18 or similar device, as schematically shown in FIG. 5, so as to filter any light between the light source system and the viewer. A third type of delivery system utilizes pigmented pellets in the coloring of an extruded hollow fluorescent tube sleeve 20, schematically shown in FIG. 6, so that the light emitted from the light source would be automatically filtered.

What is claimed is:

1. A filter to be positioned between a standard fluorescent light source and an area to be illuminated, said filter including a substrate which contains a mixture of color pigments embedded within a plastic matrix, said mixture being selected to modify the spectral output generated by the light source to resemble all colors of the spectral output of natural daylight.

2. The filter of claim 1, including an ultraviolet absorber in said filter.

3. The filter of claim 1, wherein said mixture includes violet, black and green pigments.

4. The device of claim 3, wherein the artificial light is a standard cool-white fluorescent lamp.

5. The filter of claim 3, wherein the pigment mixture contains about 50% violet, about 40% black, and about 10% green.

6. The filter of claim 3, wherein the pigment mixture contains about 41% violet, about 47% black, and about 12% green.

7. The filter of claim 1, in the form of a flat thin plastic prismatic panel configured to be positioned in a fluorescent light fixture beneath a cool-white fluorescent light bulb.

8. The filter of claim 1, wherein the light source is a cool-white fluorescent light source having a Kelvin temperature of about 4150.

9. The filter of claim 8, in a form selected from the group consisting of a thin plastic sheet and a panel, wherein said filter is positioned on top of a louver of the type positioned in a fluorescent light fixture beneath a fluorescent light bulb.

10. The filter of claim 9, wherein said louver is a parabolic wedge louver.

11. The filter of claim 1, wherein the light transmitted from said filter has a non-variable spectral light distribution.

12. The filter of claim 8, in the form of an extruded plastic tube configured to be positioned around an elongated fluorescent light source.

13. The filter of claim 1, wherein the pigment mixture modifying the spectral output generated by the light source produces light which contains violet which is about 34% less than green, blue about 3% less than green, yellow about 7% less than green, orange about 24% less than green, and red about 38% less than green.

14. The filter of claim 1, being configured to transmit from 60–90% of the light from said source.

15. A method of filtering artificial light to simulate natural daylight, comprising positioning a filter between a standard fluorescent light source and an area to be illuminated, said filter including a substrate which contains a mixture of color pigments embedded within a plastic matrix and selected to modify the spectral output generated by the light source to resemble all colors of the spectral output of natural daylight, wherein said filter transmits at least 60% of the light from said source.

16. The method of claim 15, including in said mixture an ultraviolet light absorber.

17. The method of claim 15, wherein the light output obtained from said filtering step includes violet which has about 34% less than green, blue which is about 3% less than green, yellow which is about 7% less than green, orange which is about 24% less than green, and red which is about 38% less than green.

18. The filter of claim 15, wherein the light transmitted from said filter has a non-variable spectral light distribution.

19. A method of making a filter to modify standard fluorescent light to simulate natural daylights comprising:

mixing pigment with uncolored plastic to form a sample with concentrated pigment; and mixing a portion of said sample with a much greater quantity of uncolored plastic, said mixture being formulated to produce a panel which provides a spectral output having violet which is about 34% less than green, blue which is about 3% less than green, yellow which is about 7% less than green, orange which is about 24% less than green, and red which is about 38% less than green.

20. The method of claim 19, wherein said pigment is mixed with clear plastic pellets to create colored pellets.

21. The method of claim 20, wherein said colored pellets are combined with a larger quantity of clear plastic pellets to be fabricated into a form selected from the group consisting of a prismatic panel, a plain flat panel, and a sleeve for fitting around a fluorescent lamp.

22. The method of claim 19, wherein said pigment mixing creates a pigment mixture which is about 50% violet, about 40% black, and about 10% green.

23. The method of claim 19, wherein the light transmitted from said filter has a non-variable spectral light distribution.

24. A filter comprising a thin flat panel to be positioned in a light fixture between a standard cool-white fluorescent lamp and a room to be illuminated, said panel comprising pigments that will modify the light from the lamp to simulate daylight and an ultraviolet light absorber, wherein said filter transmits at least 60% of the light from said lamp.

25. The method of claim 24, wherein the light transmitted from said filter has a non-variable spectral light distribution.

* * * * *